US010226802B2

(12) United States Patent
Frobose

(10) Patent No.: US 10,226,802 B2
(45) Date of Patent: Mar. 12, 2019

(54) COLD PILGER ROLLING MILL AND METHOD FOR FORMING A TUBE SHELL TO A TUBE

(71) Applicant: SANDVIK MATERIALS TECHNOLOGY DEUTSCHLAND GMBH, Dusseldorf (DE)

(72) Inventor: Thomas Frobose, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 339 days.

(21) Appl. No.: 14/914,550

(22) PCT Filed: Aug. 14, 2014

(86) PCT No.: PCT/EP2014/067414
§ 371 (c)(1),
(2) Date: Feb. 25, 2016

(87) PCT Pub. No.: WO2015/028317
PCT Pub. Date: Mar. 5, 2015

(65) Prior Publication Data

US 2016/0199893 A1 Jul. 14, 2016

(30) Foreign Application Priority Data

Aug. 26, 2013 (DE) ..... 10 2013 109 218

(51) Int. Cl.
*B21B 21/00* (2006.01)
*B21B 21/04* (2006.01)
(Continued)

(52) U.S. Cl.
CPC ..... *B21B 21/005* (2013.01); *B21B 21/045* (2013.01); *B21B 37/78* (2013.01); *B21B 38/00* (2013.01)

(58) Field of Classification Search
CPC ..... B21B 21/00; B21B 21/005; B21B 21/04; B21B 21/045; B21B 37/78; B21B 38/08; B21B 38/00
See application file for complete search history.

(56) References Cited

U.S. PATENT DOCUMENTS 4,562,713 A 1/1986 Kondoh
5,418,456 A 5/1995 Cook et al.
(Continued)

FOREIGN PATENT DOCUMENTS

CN 1328886 A 1/2002
CN 1519064 A 8/2004
(Continued)

OTHER PUBLICATIONS

Machine Translation, JP 54-19455A, Feb. 1979.*
Office Action dated Jul. 31, 2018, issued in corresponding Japanese Patent Application No. 2016-537213.

*Primary Examiner* — Edward Tolan
(74) *Attorney, Agent, or Firm* — Morgan, Lewis & Bockius LLP

(57) ABSTRACT

A cold pilger rolling mill for forming a tube shell to a tube includes a feed clamping carriage for receiving the tube shell and with a drive that is arranged to move the feed clamping carriage such that during the operation of the cold pilger rolling mill the tube shell moves step-by-step in the direction of the tool. A control and a sensor detect a measure of a force exerted during the operation of the cold pilger rolling mill by the tool onto the tube shell, and wherein the control is connected to the drive and the sensor. The control is arranged to regulate, during the operation of the cold pilger rolling mill, the step length per advance step with which the drive moves the feed clamping carriage to the tool as a function of the measure for the force, which measure is detected by the sensor.

13 Claims, 1 Drawing Sheet

(51) Int. Cl.
*B21B 37/78* (2006.01)
*B21B 38/00* (2006.01)

(56) References Cited

U.S. PATENT DOCUMENTS

| | | | | |
|---|---|---|---|---|
| 5,548,987 | A | 8/1996 | Hausler | |
| 6,012,313 | A | 1/2000 | Persico | |
| 2012/0234074 | A1 | 9/2012 | Hagen | |
| 2013/0042660 | A1* | 2/2013 | Baensch | B21B 21/00 72/12.8 |
| 2013/0186214 | A1* | 7/2013 | Frobose | B21B 21/005 74/44 |
| 2013/0205851 | A1* | 8/2013 | Haverkamp | B21B 21/00 72/12.8 |

FOREIGN PATENT DOCUMENTS

| | | | | | |
|---|---|---|---|---|---|
| CN | 102858475 | A | | 1/2013 | |
| DE | 102011110939 | A1 | | 2/2013 | |
| GB | 1275820 | | | 5/1972 | |
| GB | 1518314 | A | | 7/1978 | |
| JP | S51-29359 | A | | 3/1976 | |
| JP | 54-19455 | A | * | 2/1979 | B21B 21/00 |
| JP | S59-76603 | A | | 5/1984 | |
| JP | S59159204 | A | | 9/1984 | |
| JP | H02-52109 | A | | 2/1990 | |
| JP | H0470082 | B2 | | 11/1992 | |
| JP | 2000-312906 | A | * | 11/2000 | B21B 21/00 |
| JP | 2007038296 | A | | 2/2007 | |

* cited by examiner

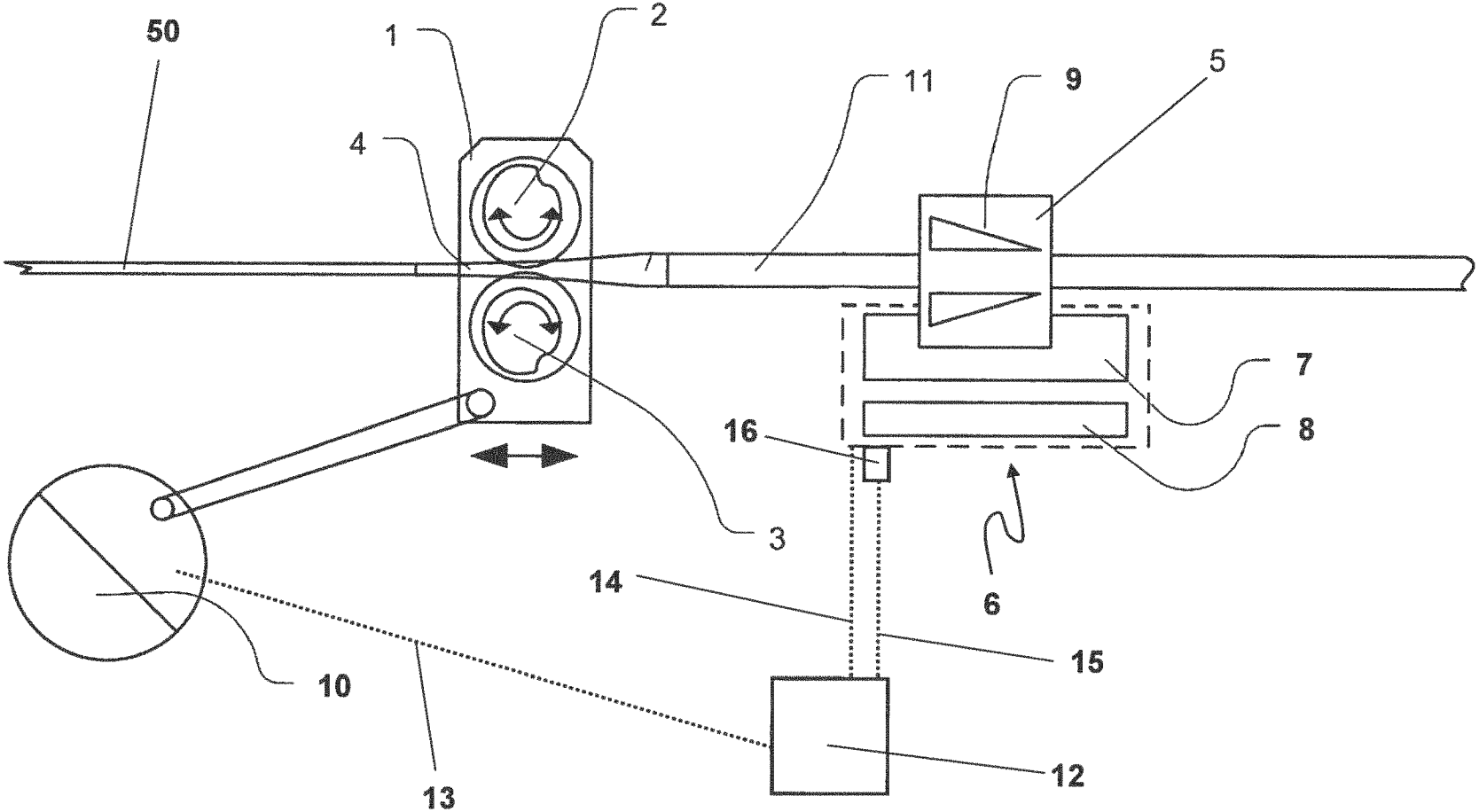
50
1
2
4
11
3
9
5
16
7
8
6
14
15
12
13
10

COLD PILGER ROLLING MILL AND METHOD FOR FORMING A TUBE SHELL TO A TUBE

RELATED APPLICATION DATA

This application is a § 371 National Stage Application of PCT International Application No. PCT/EP2014/067414 filed Aug. 14, 2014 claiming priority of DE Application No. 102013109218.7, filed Aug. 26, 2013.

The present invention relates to a cold pilger rolling mill for forming a tube shell to a tube with a pair of rolls that are rotatably attached to a roll stand and with a roll mandrel as a tool, a feed clamping carriage for receiving the tube shell and with a drive for the feed clamping saddle that is arranged in such a manner that it moves the feed clamping saddle in such a manner during the operation of the cold pilger rolling mill that the tube shell moves step-by-step in the direction of the tool.

The invention additionally relates to a method for forming a tube shell to a tube with the steps: providing a cold pilger rolling mill with a pair of rolls that are rotatably attached to a roll stand and with a roll mandrel as a tool, a feed clamping saddle with the tube shell received in it and with a drive for the feed clamping saddle; moving the feed clamping saddle with the aid of the drive in such a manner that the tube shell moves step-by-step in the direction of the tool.

In order to manufacture precise metal tubes, in particular consisting of high-grade steel, an expanded, hollow, tubular blank that is also designated as a tube shell, is reduced cold in a completely cool state by pressure tensions. The tube shell is thereby formed to a tube with a defined, reduced outside diameter and to a defined wall thickness.

The most common reducing method for tubes is known as cold pilgering, wherein the tube shell is pushed over a calibrated, that is, having the inside diameter of the finished tube, roll mandrel and is surrounded from the outside by two calibrated, that is, defining the outside diameter of the finished tube, rolls and is rolled out in the longitudinal direction over the roll mandrel.

During the cold pilgering the tube shell experiences a step-by-step advance in the direction of the roll mandrel and beyond it. Between two advance steps the rolls are moved in a rotating manner over the mandrel and therefore over the tube shell and roll out the tube shell. At each reversal point of the roll stand the rolls free the tube shell and the latter is pushed one step further in the direction of the mandrel.

The advance of the tube shell over the mandrel is performed with the aid of a translatorily driven feed clamping carriage. The feed clamping carriage, also called feed clamping saddle, executes a movement of translation in a direction parallel to the axis of the roll mandrel and transfers the latter onto the tube shell.

During the rolling the feed clamping carriage is substantially stationary and takes up the force exerted by the tool, i.e., the rolls and the roll mandrel, onto the tube shell.

It has shown during cold pilgering that the selection of the correct velocity, in particular, however, the step length with which the tube shell is advanced in the direction of the tool has a considerable influence on the force exerted by the tool on the tube shell and therefore on the quality of the finished tube and the service life of the advance drive, i.e. the feed clamping carriage.

Therefore, it is the object of the present invention to provide a cold pilger rolling mill for forming a tube shell to a tube that makes possible the forming of the tube shell to a tube with a controlled force exerted by the tool onto the tube shell. It is in particular it is also an object of the present invention to provide a cold pilger rolling mill that makes it possible to manufacture tubes with an improved quality. In addition, it is an object of the invention to provide a cold pilger rolling mill that has an improved service life.

At least one of the previously cited objects is achieved by a cold pilger rolling mill for forming a tube shell to a tube with a pair of rolls that are rotatably fastened on a roll stand and with a roll mandrel as a tool, with an feed clamping carriage for receiving the tube shell and with a drive for the feed clamping carriage that is arranged in such a manner that it moves in such a manner during the operation of the cold pilger rolling mill that the tube shell moves step-by-step in a direction onto the tool, wherein the cold pilger rolling mill furthermore comprises a control and a sensor for detecting a measure for a force exerted during the operation of the cold pilger rolling mill by the tool onto the tube shell, wherein the control is connected to the drive and the sensor, and wherein the control is arranged in such a manner that it regulates during the operation of the cold pilger rolling mill the step length per advance step with which the drive moves the feed clamping carriage onto the tool as a function of the measure for the force, which measure is determined by the sensor.

During the rolling with a cold pilgering rolling mill the tool, in particular the rolls exert a force on the tube shell that opposes the holding force exerted by the drive via the feed clamping carriage onto the tube shell. The force exerted by the tool on the tube shell is a function in particular of the dimensions of the tube shell to be reduced but also of the step length per advance step with which the tube shell is pushed forward between the rolls onto the tool.

It has shown that the force exerted by the tool onto the tube shell during rolling is reduced when the step length per advance step is reduced. The present invention makes use of this insight in that it regulates the step length of the feed clamping carriage per advance step during the rolling as a function of the measure for this force, which measure is detected by the sensor.

In the sense of the present invention the step length per advance step is the translation path that the tube shell and the feed clamping carriage travels during a single step-by-step advance step between two roll passages.

A sensor for detecting a measure for the force exerted by the tool on the tube shell is, for example a load cell, which directly measures this force. In another embodiment this force can be derived from a position measurement of the feed clamping carriage.

During the cold pilgering the tube shell experiences a step-by-step advance in the direction of the roll mandrel and beyond it with the aid of the clamping carriage driven by the drive, which carriage is also designated as a feed clamping carriage in a cold pilgering rolling mill. Between two advance steps the rolls are moved while rotating over the mandrel and therefore over the tube shell. The horizontal movement of the rolls is set here by a roll stand on which the rolls are rotatably supported.

The roll stand is moved back and forth in pilger rolling mills with the aid of a crank drive in a direction parallel to the roll mandrel while the rolls themselves typically receive their rotary movement by a toothed rack that is stationary relative to the roll stand and into which rack teeth permanently connected to the roll shafts engage. The rolls free the tube shell at each reversal point of the roll stand and the tube shell is moved by a further advance step onto the tool. At the same time the tube shell experiences a rotation about its axis in order to achieve a uniform shape of the finished tube.

The so-called "pilger mouth" formed by the rolls grasps the tube shell and the rolls press a small metal wave outward which is extended by the smoothing caliber of the rolls and the roll mandrel to the intended wall thickness until the idle caliber of the rolls releases the finished tube. After the rolls have reached the idle caliber the tube shell is pushed one step further onto the roll mandrel with the aid of the feed clamping carriage. Thereafter, the rolls with the roll stand return into their horizontal initial position, thereby rolling over the tube shell again. A uniform wall thickness and roundness of the tube as well as a uniform inside and outside diameter are achieved by multiply rolling over each tube section.

In an embodiment of the invention the drive is arranged in such a manner that it allows a deviating movement of the feed clamping carriage in a direction opposed to the direction of advance if the force exerted by the tool on the tube shell exceeds a holding force of the drive. The length of this compensating movement is then in particular a measure of the force exerted by the tool onto the tube shell. Such a compensating movement also prevents damage to the feed clamping carriage and to the drive.

While the drive for the feed clamping carriage traditionally is performed via a spindle drive in cold pilgering rolling mills, an embodiment of the invention is preferred in which the drive for the feed clamping carriage comprises at least one direct electromechanical linear drive.

The term electromechanical linear drive denotes in the sense of the present invention all linear motors and linear actuators that make possible a suitable travel path and a sufficient positioning accuracy without converting a rotary movement into a translation movement. They are, in addition to linear motors with electrodynamic acting principle, linear actuators with piezoelectric, electrostatic, electromagnetic, magnetostrictive or thermoelectric acting principle.

Such a direct electromechanical linear drive, in particular a linear motor, has the advantage that it acts directly on the feed clamping carriage and operates without contact and therefore is almost completely wear-free.

The advance forces are introduced by the linear drive directly into the feed clamping carriage. A conversion of the rotary movement of a servodrive via transmissions, spindle and spindle nut into a translation movement such as in a spindle drive is eliminated. Therefore the number of mechanical components is clearly reduced, which, among other things, reduces the expense arising from the storing of replacement parts.

However, as regards the present invention such a direct electromechanical linear drive for a feed clamping carriage has in particular the advantage that it can be directly and very precisely controlled as regards the step length per advance step.

In an embodiment the direct electromechanical linear drive additionally comprises a hydraulic or pneumatic brake that opposes a displacement of the feed clamping carriage opposite to the direction of advance. The static holding forces of the electromechanical linear drive are supplemented with such a brake during the rolling. In addition, such a hydraulic or pneumatic brake has the advantage that it allows a compensatory movement of the feed clamping carriage within defined limits, as described above.

In one embodiment of the invention the step length of the tube shell per advance step is regulated in such a manner that the force derived or derivable from the measurement from the sensor is below a pre-determined threshold value.

At the same time, in one embodiment of the invention the step length per advance step of the cold pilger rolling mill is selected to be as large as possible in the sense of maximum productivity.

To this end the control is arranged in such a manner in an embodiment of the invention that it controls the step length per advance step of the clamping carriage during the operation of the cold pilger rolling mill in such a manner that the step length increases as long as the force derived or derivable from a measurement of the sensor is below a pre-determined threshold value.

In one embodiment of the invention the sensor for detecting a measure for the force exerted in the operation of the cold pilger rolling mill by the tool onto the tube shell is a position sensor that detects an actual position of the feed clamping carriage, wherein the control is arranged in such a manner that it compares the actual position detected by the sensor with a nominal position of the feed clamping carriage, wherein a difference between the actual position and the nominal position is a measure for the force exerted by the tool on the tube shell.

If it is assumed that the opposite force with which the feed clamping carriage is statically held by the drive during the rolling is known, then the force with which the tool is acting on the tube shell can be derived from the difference between the planned nominal position of the feed clamping carriage and the current actual position.

Since, as described on above, the force exerted by the tool on the tube shell is a function, among other things, of the step length per advance step, the step length of the feed clamping carriage can be regulated in such a manner in one embodiment that the difference between the actual position and the nominal position is minimal, is below a pre-determined threshold value or lies within a pre-determined tolerance window.

The maximal step length is adjusted and pre-determined in such a manner in one embodiment that it makes an automatic operation of the mill possible in that the mill regulates the drive in such a manner after the starting that the step length of the clamping carriage is an optimal balance between the force exerted by the tool on the tube shell and the processing time.

In another embodiment the regulating in accordance with the invention serves in particular to compensate fluctuations in the dimensions of the tube shell. If the tube shell to be rolled has, for example, a section with an enlarged wall thickness, this has the result that the force exerted by the tool on the tube shell increases during the rolling of this section in comparison to the other sections of the tube shell. In order to oppose this increase of the force, the step length is then reduced until the force derived or derivable from the measurements of the sensor has returned below a pre-determined threshold value. According to one embodiment of the invention the control attempts at the same time to keep the step length as large as possible in order to optimize the productivity of the mill. As soon as a drop of the force exerted by the tool on the tube shell is detected upon reaching a tube section with the normal dimensions (in comparison to the thickened section), the control increases the step length again.

In one embodiment of the invention the control is set up in such a manner that it controls the step length of the feed clamping carriage per advance step during the operation of the cold pilger rolling mill in such a manner that the difference between the actual position of the feed clamping carriage and the nominal position thereof is smaller than a pre-determined threshold value or lies in a pre-determined tolerance window.

The level of this threshold value for the upper and lower boundary properties of the tolerance window depends in one embodiment on the quality requirements of the cold-formed tube. It is assumed here that the smaller the deviation between the actual position and the nominal position of the clamping carriage is, the better the quality of the tube is. In addition, the dimensioning of the drive also has an influence on the pre-set properties. The goal is to prevent damage to the drive caused by exceeding a pre-determined critical force exerted by the tool on the tube shell.

At least one of the above-cited objects of the present invention is also achieved by a method for forming a tube shell to a tube with the steps: providing a cold pilger rolling mill with a pair of rolls that are rotatably attached on a roll stand, and with a roll mandrel as a tool, with a feed clamping carriage with a tube shell received in it and with a drive for the feed clamping carriage, moving the feed clamping carriage with the aid of the drive in such a manner that the tube shell is moved step-by-step in a direction onto the tool, wherein the method furthermore comprises the steps: detecting a measure for a force exerted by the tool on the tube shell with a sensor and, with the aid of a control, regulating the step length per advance step with which the drive moves the tube shell onto the tool as a function of the measure for the force, detected by the sensor.

Advantageously, a fluctuation in the dimensions of the tube shell is compensated with the aid of the method.

Advantageously, the operation of a cold pilger rolling mill for forming a tube shell with a dimensioning unknown to the control is started with the aid of the method.

In as far as aspects of the invention were already described previously regarding the cold pilger rolling mill, they also apply to the corresponding method for forming a tube shell to a tube and vice versa. In as far as the method is carried out with a cold pilger rolling mill in accordance with this invention it has the corresponding devices for this. In particular, embodiments of the cold pilger rolling mill are also suitable for carrying out the described embodiments of the method.

In as far as the previously described embodiments of the method can be realized at least partially, wherein a software-controlled data processing unit is used, it is apparent that a computer program that makes such a software control available and the storage medium in which such a computer program is stored are to be considered as aspects of the invention.

Further advantages, features and possibilities of using the present invention will become clear using the following description of a preferred embodiment and the associated FIGURE.

FIG. 1 shows a schematic side view of the construction of a cold pilger rolling mill according to an embodiment of the present invention.

The construction of a cold pilger rolling mill is schematically shown in a side view in FIG. 1. The roll mill consists of a roll stand 1 with rolls 2, 3, a calibrated roll mandrel 4 and a feed clamping carriage 5. The rolls 2, 3 form together with the roll mandrel 4 the tool of the cold pilger rolling mill in the sense of the present invention. It should be noted that in FIG. 1 the position of the roll mandrel 4 cannot be seen inside the tube shell 11.

In the embodiment shown the cold pilger rolling mill comprises a linear motor designated by the reference numeral 6 in FIG. 1. The linear motor 6 forms a direct drive for the feed clamping carriage 5 and is constructed by a rotor 7 and a stator 8. During the cold pilgering in the rolling mill shown in FIG. 1 the tube shell 11 experiences a step-by-step advance in the direction of the roll mandrel 4 and beyond it. The rolls 2, 3 are moved horizontally back and forth while rotating over the mandrel 4 and therefore over the tube shell 11. During this time the horizontal movement of the rolls 2, 3 is set by the roll stand 1 in which the rolls 2, 3 are rotatably supported. The roll stand 1 is moved back and forth with the aid of a crank drive 10 in a direction parallel to the roll mandrel. The rolls 2, 3 receive their rotary motion from a toothed rack that is stationary relative to the roll stand and into which toothed gears firmly connected to the roll shafts engage.

The advance of the tube shell 11 is performed at the reversal points of the roll stand 1 with the aid of the feed clamping carriage 5 that, driven by the linear motor 6, makes possible a movement of translation in a direction parallel to the axis of the roll mandrel. The so-called "pilger mouth" formed by the rolls grasps the tube shell 11 after each advance and the rolls 2, 3 press from the outside a small metal wave away that is extended by the smoothing caliber of the rolls 2, 3 and the roll mandrel 4 to the intended wall thickness until an idle caliber of the rolls 2, 3 frees the finished tube again.

The tube shell 11 is advanced by a further step toward the roll mandrel 4 with the aid of the feed clamping carriage 5 after having reached the idle caliber of the rolls 2, 3. At the same time the tube shell 11 experiences a rotation about its axis in order to achieve a uniform shape of the finished tube. A uniform wall thickness and roundness of the tube as well as a uniform inside and outside diameter are achieved by multiply rolling over each tube section.

A central sequencing control 12 controls the drives 6, 10 of the rolling mill, that are at first independent, so that the previously described course of the rolling process is achieved. The control 12 begins with the release of an advance step of the linear motor 6 for advancing the tube shell 11. Upon reaching the advance position, i.e. the end of the advance step, the linear motor 6 is controlled in such a manner that it statically holds the feed clamping carriage 5 and the velocity of the rotation of the crank drive is controlled in such a manner that after the ending of each advance step the roll stand 1 is pushed horizontally over the tube shell 11, wherein the rolls 2, 3 roll out the tube shell 11.

In order to meet its control tasks the sequencing control 12, for example an industrial PC, is connected via control lines 13, 14 to the drive motor for the crank drive 10 and also to the linear motor 6. In addition, the sequencing control 12 detects with the aid of a measuring line 15 the actual position of the feed clamping carriage 5 mounted on the rotor 7, which position is detected by a position sensor 16 in the linear motor 6.

It has shown that the force exerted by the tool 2, 3, 4 on the tube shell 11 depends in particular on the properties of the tube shell, especially on its dimensions. If this action of the force is below a pre-determined threshold value a sufficient quality of the tube can be ensured and damage to the feed clamping carriage 5 or to the drive 6 can be prevented. However, the force exerted by the tool 2, 3,4 on the tube shell 11 also depends on the step length with which the feed clamping carriage 5, and with it the tube shell 11, is moved per advance step to the tool 2, 3, 4.

If the action of the force of the tool 2, 3, 4 onto the tube shell 11 is very large the feed clamping carriage 5 on the rotor 7 is displaced from the nominal position given to it by the sequencing control 12 via the control line 14 opposite to the direction of advance. I.e., the holding force exerted by the linear motor 6 is less than the force exerted by the tool 2, 3, 4 on the tube shell 11. Due to this fact, a deviation then results between the nominal position of the feed clamping carriage 5 given by the linear motor 6 and the actual position of the carriage 5 detected by the measuring line 15 during the rolling. The deviation or difference between the nominal position and the actual position is then a measure for the force exerted by the tool 2, 3, 4 on the tube shell 11.

If the difference between the nominal position and the actual position of the feed clamping carriage 5 is above a pre-determined threshold value, it is assumed that the action of the force of the tool 2, 3, 4 on the tube shell 11 is too large in order to still ensure a sufficient quality of the tube after the roll stand 1. In order to reduce the force exerted by the tool 2, 3, 4 on the tube shell 11, the sequencing control 12 then reduces the step length with which the feed clamping carriage 5 is moved per advance step onto the tool 2, 3 4. The force exerted by the tool 2, 3, 4 on the tube shell 11 will also decrease as the velocity of the feed clamping carriage 5 becomes less, so that the difference between the nominal position and the actual position of the feed clamping carriage 5 again is below the threshold value that ensures the necessary quality. However, at the same time the control 12 attempts to hold the step length of the feed clamping carriage 5 at a maximum in order to also ensure the necessary productivity of the mill in addition to the necessary quality. For this purpose, the control has not only an upper threshold value for the difference between the actual position and the nominal position of the feed clamping carriage but also a lower threshold value that together define a tolerance window. If the deviation between the actual position and the nominal position of the carriage falls below the lower threshold value then the step length can be increased again in order to retain the productivity of the mill.

It is pointed out for purposes of the original disclosure that all features that are apparent to a person skilled in the art from the present specification, the drawing and the claims, even if they were also concretely described in conjunction with certain other features, can be combined individually as well as in any combinations with other features or groups of features disclosed here in as far as this was not expressly excluded or if technical circumstances render such combinations impossible or illogical. A comprehensive, explicit presentation of all conceivable feature combinations will not be given here for the sake of brevity and the legibility of the specification.

If the invention was presented in detail in the drawings and the previous specification, this presentation and specification are performed solely by way of example and is not meant as a limitation of the protective scope as defined by the claims. The invention is not limited to the disclosed embodiments.

Modifications to the disclosed embodiments are obvious to the person skilled in the art from the drawings and the specification. In the claims the words "comprises" does not exclude other elements or steps and the indefinite article "a" or "one" does not exclude the plural. The mere fact that certain features are claimed in different claims does not exclude their combination. Reference numerals in the claims are not meant to be a limitation of the protective scope.

The invention claimed is:

1. A cold pilger rolling mill for forming a tube shell to a tube with a pair of rolls that are rotatably attached to a roll stand and with a roll mandrel as a tool, the cold pilger rolling mill comprising:

a feed clamping carriage for receiving the tube shell;

a drive for the feed clamping carriage arranged to move the feed clamping carriage during operation of the cold pilger rolling mill such that the tube shell moves step-by-step in a direction of the tool; and a control and a sensor for detecting a measure for a force exerted during operation of the cold pilger rolling mill by the tool onto the tube shell, wherein the control is connected to the drive and the sensor, wherein the control is arranged to regulate, during operation of the cold pilger rolling mill, a step length per advance step with which the drive moves the feed clamping carriage onto the tool as a function of the measure for the force, wherein the sensor is a position sensor that detects an actual position of the feed clamping carriage, wherein the control is arranged to compare the actual position of the feed clamping carriage detected by the sensor with a nominal position of the feed clamping carriage, and wherein a difference between the actual position and the nominal position is a measure of the force exerted during operation of the cold pilger rolling mill by the tool onto the tube shell.

2. The cold pilger rolling mill according to claim 1, wherein the control is arranged to regulate the step length per advance step during operation of the cold pilger rolling mill in such a manner that the measure of the force is below a pre-determined threshold value.

3. The cold pilger rolling mill according to claim 2, wherein the control is arranged to control the step length per advance step of the feed clamping carriage during operation of the cold pilger rolling mill in such a manner that maximizes the step length per advance step.

4. The cold pilger rolling mill according to claim 1, wherein the control is arranged to detect the measure for the force exerted by the tool onto the tube shell in a stationary state of the drive and during rolling over with the pair of rolls.

5. The cold pilger rolling mill according to claim 4, wherein the control reduces the step length per advance step if the force exerted during operation of the cold pilger rolling mill by the tool onto the tube shell and derived or derivable from a measurement of the sensor is above a pre-determined threshold value.

6. The cold pilger rolling mill according to claim 1, wherein the control is arranged to control the step length per advance step of the feed clamping carriage during operation of the cold pilger rolling mill in such a manner that the difference between the actual position of the feed clamping carriage and the nominal position of the feed clamping carriage is less than a pre-determined threshold value.

7. The cold pilger rolling mill according to claim 1, wherein the drive is arranged to allow a deviating movement of the feed clamping carriage in a direction opposed to a direction of advance of the tube shell if the measure of the force exerted during operation of the cold pilger rolling mill by the tool onto the tube shell exceeds a holding force of the drive.

8. The cold pilger rolling mill according to claim 1, wherein the drive for the feed clamping carriage includes at least one direct electromechanical linear drive.

9. The cold pilger rolling mill according to claim 8, wherein the at least one direct electromechanical linear drive includes a hydraulic or pneumatic brake.

10. The cold pilger rolling mill according to claim 1, wherein the control reduces the step length per advance step if the force exerted during operation of the cold pilger rolling mill by the tool onto the tube shell and derived or derivable from a measurement of the sensor is above a pre-determined threshold value.

11. A method for forming a tube shell to a tube comprising the steps of:

providing a cold pilger rolling mill having a pair of rolls that are rotatably attached to a roll stand and including a roll mandrel as a tool, a feed clamping carriage in which a tube shell is received, and a drive for the feed clamping carriage;

moving the feed clamping carriage with the drive such that the tube shell moves step-by-step in a direction of the tool;

detecting an actual position of the feed clamping carriage with a position sensor;

comparing the actual position of the feed clamping carriage detected by the sensor with a nominal position of the feed clamping carriage, wherein a difference between the actual position and the nominal position is a measure for the force exerted during operation of the cold pilger rolling mill by the tool onto the tube shell; and regulating a step length per advance step with which the drive moves the tube shell to the tool as a function of the measure for the force.

12. The method according to claim 11, wherein the measure for the force exerted during operation of the cold pilger rolling mill by the tool onto the tube shell is below a pre-determined threshold value.

13. The method according to claim 12, wherein regulating the step length per advance step maximizes the step length per advance step.

* * * * *